US007780489B2

(12) United States Patent
Stuklek

(10) Patent No.: US 7,780,489 B2
(45) Date of Patent: Aug. 24, 2010

(54) SPRING CONTACT FOR AN ELECTRICAL PLUG CONNECTION AND PLUG CONNECTION

(75) Inventor: Franc Stuklek, Celje (SI)

(73) Assignee: ELRAD International d.o.o., Gornja Radgona (SI)

( * ) Notice: Subject to any disclaimer, the term of this patent is extended or adjusted under 35 U.S.C. 154(b) by 0 days.

(21) Appl. No.: 12/218,618

(22) Filed: Jul. 16, 2008

(65) Prior Publication Data

US 2009/0053941 A1 Feb. 26, 2009

(30) Foreign Application Priority Data

Jul. 16, 2007 (DE) ..... 10 2007 032 992

(51) Int. Cl.
*H01R 13/05* (2006.01)

(52) U.S. Cl. ..... 439/825

(58) Field of Classification Search ..... 439/825, 439/745, 843, 844, 839, 891, 847, 660, 79, 439/65, 947

See application file for complete search history.

(56) References Cited

U.S. PATENT DOCUMENTS 4,540,235 A * 9/1985 Lolic ..... 439/839
5,338,229 A * 8/1994 Egenolf ..... 439/839
5,618,187 A * 4/1997 Goto ..... 439/79
6,319,075 B1 * 11/2001 Clark et al. ..... 439/825
6,551,143 B2 * 4/2003 Tanaka et al. ..... 439/682
7,309,242 B2 * 12/2007 Clark et al. ..... 439/79

* cited by examiner

*Primary Examiner*—Alexander Gilman
(74) *Attorney, Agent, or Firm*—Pauley Petersen & Erickson

(57) ABSTRACT

A spring contact for an electrical plug connection, which at one end has at least two opposing spring-elastic contact legs for receiving a counterpart contact that can be inserted between the two contact legs in an insertion direction along a central longitudinal axis of the spring contact. The outsides of the contact legs oriented away from the central longitudinal axis are each engaged by respective spring legs which press the respective opposing contact legs toward each other perpendicular to the central longitudinal axis and, when a counterpart contact is inserted, exert a respective contact pressure on the latter. A plug connection can be equipped with at least one spring contact of this invention. A plug connection of this invention can be used between a power tool and a rechargeable battery.

28 Claims, 5 Drawing Sheets

SPRING CONTACT FOR AN ELECTRICAL PLUG CONNECTION AND PLUG CONNECTION

BACKGROUND OF THE INVENTION

1. Field of the Invention

This invention relates to a spring contact for an electrical plug connection, which has at least two spring-elastic contact legs situated opposite each other at one end for receiving a counterpart contact that can be inserted between the two contact legs in an insertion direction along a central longitudinal axis of the spring contact. This invention also relates to a plug connection with at least one spring contact of this kind.

2. Discussion of Related Art

Spring contacts for receiving knife blade contacts are known from the prior art. Particularly in battery-operated power tools such as rotary hammers, the batteries or rechargeable batteries are electrically contacted to the power tool via rigid knife blade contact strips and spring contact strips. Ever more powerful battery-operated power tools have been developed in which sometimes, high peak currents of up to 150 amperes flow. These high currents place particularly powerful stresses on the plug connection between the rechargeable battery and the power tool. The rigid knife blade contact strips and spring contact strips used previously have the disadvantage that the two contact strips must be exactly flush with each other to produce a sufficient electrical contact. But if the contact strips or individual contacts are not flush with one another, then vibrations of the kind that occur, for example in rotary hammers, can result in contact erosion due to insufficiently large contact areas and contacting forces.

SUMMARY OF THE INVENTION

One object of this invention is to provide a spring contact and a plug connection with a spring contact, which can offer an improved contacting between the spring contact and a counterpart contact.

This object of this invention is attained by a spring contact and by a plug connection having characteristics described in this specification and in the claims.

In the spring contact according to this invention, a respective spring leg engages each of the outsides of the contact legs oriented away from the central longitudinal axis. The spring legs press the opposing contact legs toward each other, perpendicular to the central longitudinal axis. When a counterpart contact is inserted, the spring legs each exert a respective contact pressure on the counterpart contact.

The contact legs are embodied as spring-elastic and very flexible so that when contacting a counterpart contact, they compensate for tolerances that can arise between the counterpart contact and the spring contact. The spring contacts, which can be embodied as steel springs, assure a uniform contact pressure on both sides of the inserted counterpart contact, even when the counterpart contact is not precisely flush with the spring contact. The contacting force can be simply adapted to a desired application through the selection of suitable steel springs and of the material and geometry of the spring legs.

According to one preferred embodiment, a plurality of spring-elastically suspended contact legs can be arranged in pairs opposite one another at one end of the spring contact according to this invention so that the counterpart contact can be inserted between the opposing pairs of contact legs in the insertion direction along the central longitudinal axis of the spring contact, with a respective spring leg engaging the outside of each contact leg. The contact area between the contact legs and the counterpart contact is enlarged significantly by the parallel arrangement of a plurality of pairs of contact legs that permit the insertion of a counterpart contact embodied, for example, in the form of a knife blade. In this case, the contacting remains even if there is a lateral offset or an angular tilt between the contact legs and the counterpart contact.

A particularly reliable contacting can be achieved if the contact legs situated opposite each other are approximately V-shaped at their free ends. This forms V-shaped contact elements that extend toward each other and contact the counterpart contact when inserted.

In order for the counterpart contact to be easily inserted between the opposing contact legs, the free ends of the latter can be embodied as bent and the free ends oriented away from each other.

According to another embodiment of this invention, the other end of the spring contact can have a soldering lug formed onto it, which permits the spring contact to be soldered directly to a printed circuit board. The ability of the spring contact to be soldered directly to the printed circuit board permits the spring contact according to this invention to be easily connected to an electronic circuit. The spring-elasticity and flexibility of the contact legs assure the mobility required for a tolerance compensation, despite the rigid connection to the printed circuit board.

A particularly stable connection between the spring contact and the printed circuit board can be achieved if a plurality of soldering pins are formed onto the soldering lug. In this case, the soldering pins can extend perpendicular to the central longitudinal axis of the spring contact and can thus be easily inserted into soldering holes in the printed circuit board.

The spring contact according to this invention can be manufactured in a particularly simple fashion, if from a production engineering standpoint, the contact legs and the soldering lug with the soldering pins are integrally formed out of a metal sheet with a high electrical conductivity.

A particularly good transmission of contact pressure can be achieved if the spring legs extend essentially parallel to the associated contact legs. This design is particularly compact.

According to yet another embodiment, the spring legs can be formed onto the parallel extending support walls of an essentially U-shaped spring element. The spring element in this case can embrace the opposing contact legs so that the insides of the support walls come to rest against the outsides of the contact legs. Thus, the spring element is embodied in a form of a separate component produced, for example, of steel and can easily be placed onto the contact leg arrangement during assembly of the spring contact.

In order to prevent the spring element, which is placed onto the contact leg arrangement, from being able to slide out of its functioning position, the outsides of the contact legs can be situated opposite each other to each have at least one respective hollow embodied in them and for the insides of the spring legs oriented toward the contact legs to each have a corresponding respective projection formed onto them, which engages in the respective hollow.

According to another fundamental concept of this invention, a plug connection can have at least one spring contact of this invention. It is possible for a plurality of spring contacts to be soldered parallel to one another on one side of a printed circuit board.

In order to protect the plug connection from external influences and to securely accommodate the individual components, the spring contacts can be supported from underneath by a shared lower housing component and can be covered from above by a shared upper housing component.

It is possible for the printed circuit board to be at least partially supported by the lower housing component and at least partially covered by the upper housing component. Thus, the upper housing component can be of several parts and have at least one region in which a housing cover is embodied.

In order to achieve a stable connection between the lower housing component and the upper housing component, in the region of or near the spring contacts and perpendicular to the central longitudinal axis, the lower housing component can have a plurality of recesses for receiving projections that are formed onto the upper housing component and protrude in a comb-like fashion in the direction of the lower housing component.

The spring contact according to this invention can be securely held in a simple fashion with the contact legs with the spring legs resting against them guided through the vertical slots that are defined between the recesses of the lower housing component and the projections of the upper housing component. In this instance, the slot width is determined by a sheet thicknesses of the contact legs and the spring legs.

When the bottom housing component and the upper housing component are assembled, cavities can be formed in which the spring contacts are situated. The cavities offer the spring contacts the freedom of movement required for a tolerance compensation. In order to insert counterpart contacts into the spring contacts, the cavities are open at least in the insertion direction of the counterpart contacts.

So that knife blade contacts can also be inserted into the plug connection, each of the cavities can contain at least two opposing slots, which are extending perpendicular to the central longitudinal axis and are used for the insertion of a respective knife blade contact. During insertion, a knife blade contact is oriented so that it extends between two contact legs situated opposite each other. The opposing slots are thus situated in a plane defined by the knife blade contact.

BRIEF DESCRIPTION OF THE DRAWINGS

This invention is explained in greater detail below in view of a preferred embodiment with reference to the accompanying drawing, wherein.

DETAILED DESCRIPTION OF THE INVENTION

Figure 1:
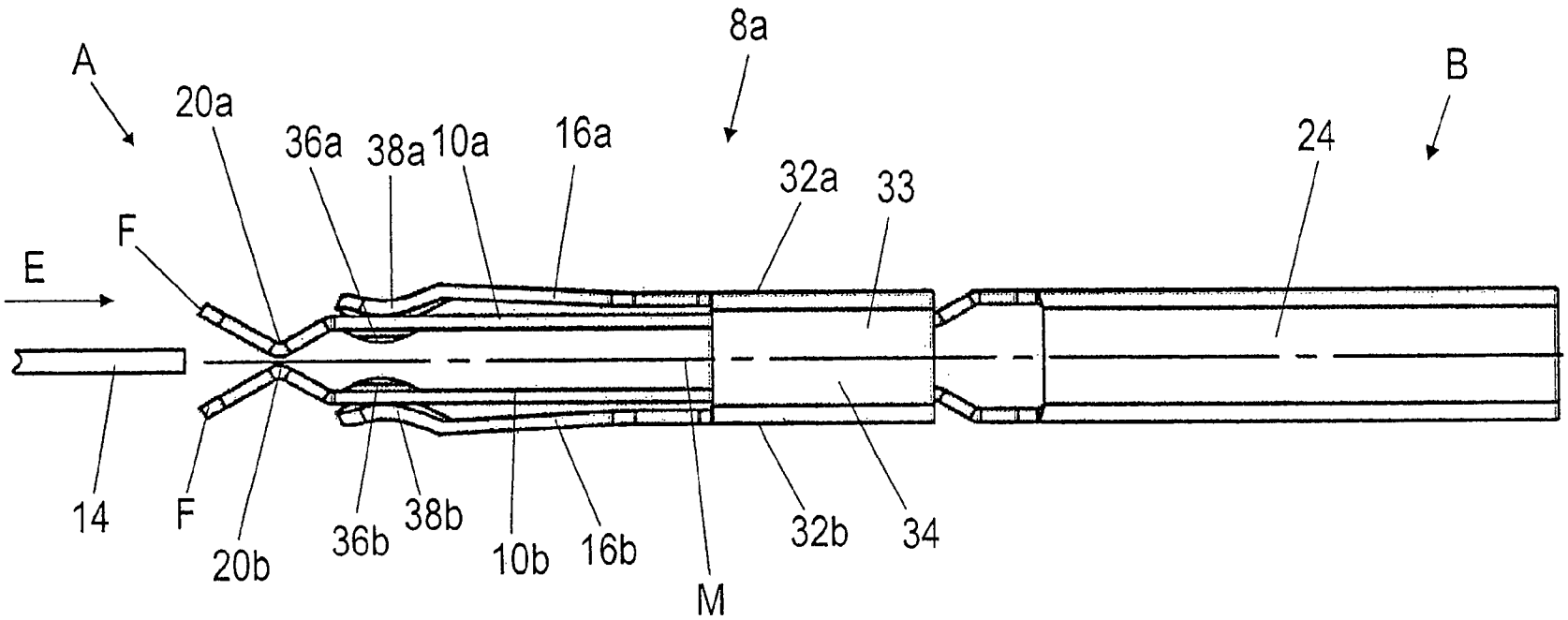
FIG. 1 is a schematic top view of a spring contact.
Figure 2:
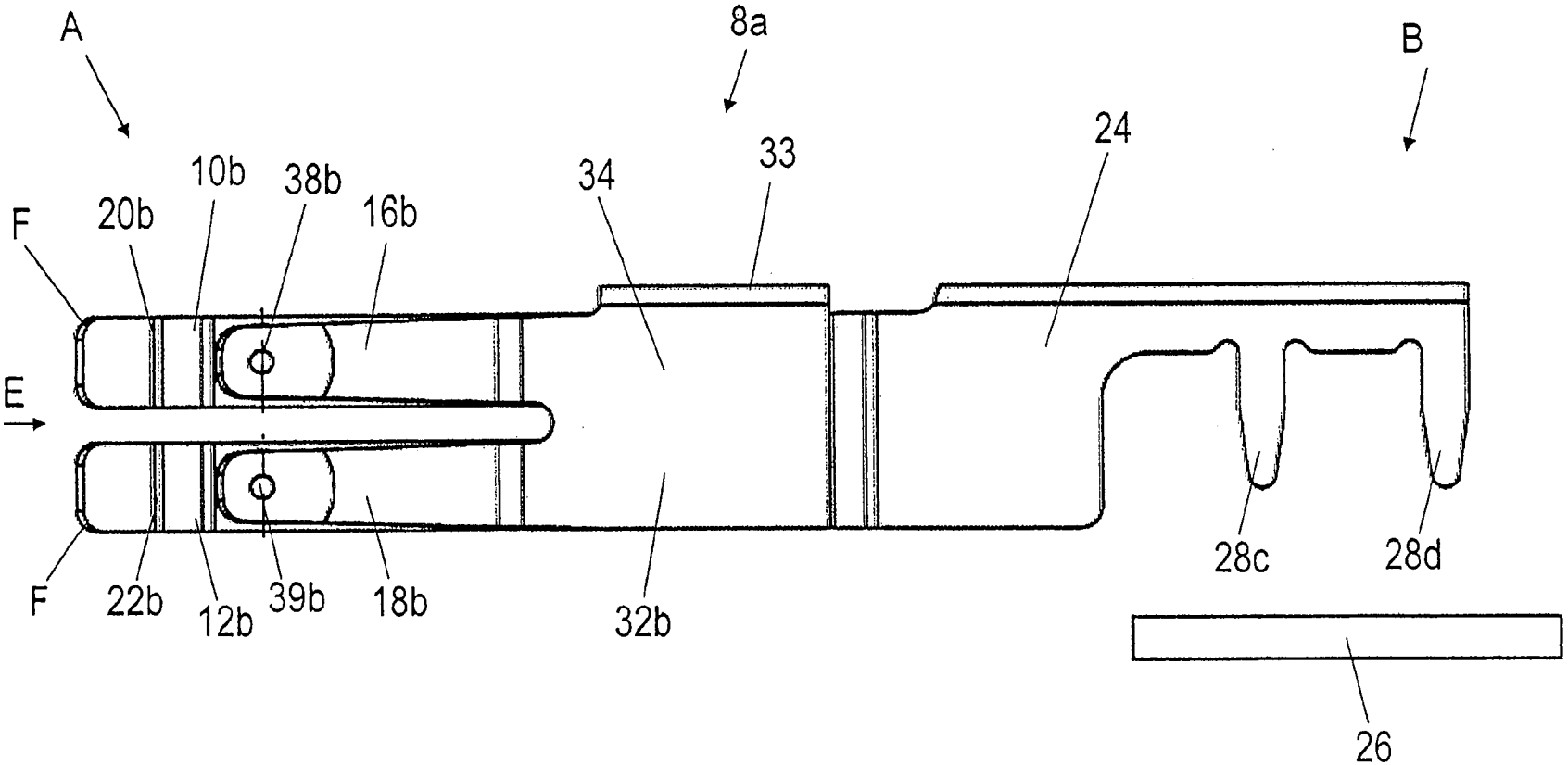
FIG. 2 is a schematic side view of the spring contact shown in FIG. 1.
Figure 3:
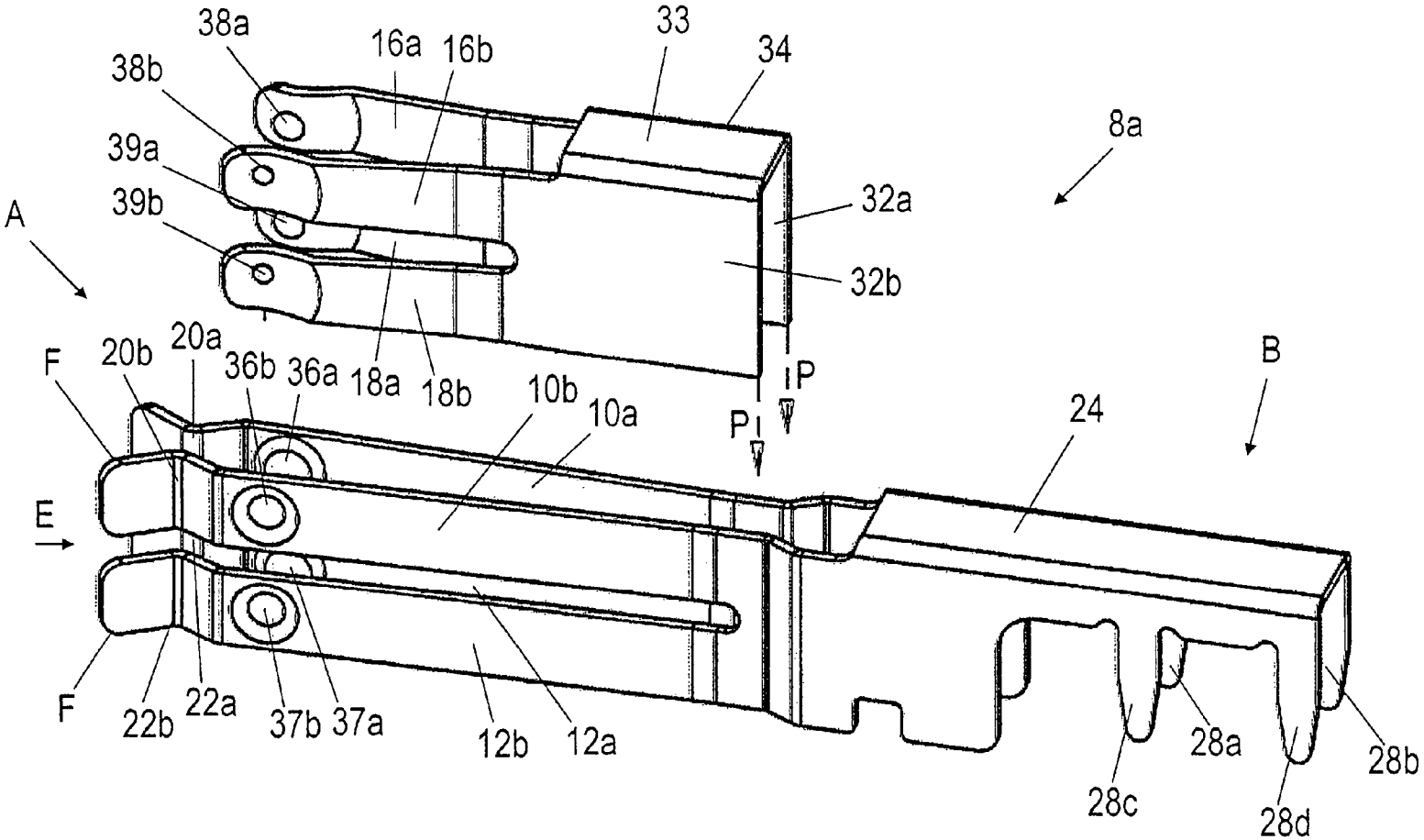
FIG. 3 is a schematic, perspective, exploded view of the spring contact shown in FIGS. 1 and 2.

FIGS. 1 through 3 schematically show different views of a spring contact 8*a* for an electrical plug connection. FIG. 1 is a top view of the spring contact 8*a*, FIG. 2 is a side view, and FIG. 3 is a perspective, exploded view.

At its end A oriented toward the left in FIGS. 1 through 3, the spring contact 8*a* has four spring-elastic contact legs 10*a*, 10*b*, 12*a* and 12*b* arranged opposite each other in pairs. A counterpart contact 14, which is only suggested in the depiction in FIG. 1, can be inserted between the opposing pairs of contact legs 10*a* and 10*b*; 12*a* and 12*b* in an insertion direction E along the central longitudinal axis M of the spring contact. The counterpart contact 14 is in a form of a knife blade contact.

Spring legs 16*a*, 16*b*, 18*a*, and 18*b* respectively engage each of the contact legs 10*a*, 10*b*, 12*a*, and 12*b* on their outsides oriented away from the central longitudinal axis M. The spring legs 16*a*, 16*b*, 18*a*, and 18*b* extend parallel to the associated contact legs 10*a*, 10*b*, 12*a*, and 12*b*. The spring legs 16*a*, 16*b*, 18*a*, and 18*b* each press the respective opposing contact legs 10*a*, 10*b*, 12*a*, and 12*b* toward each other in the direction perpendicular to the central longitudinal axis M. As a result, a contact pressure is exerted on the counterpart contact 14 when it is inserted between the two opposing contact leg pairs 10*a*, 10*b*, and 12*a*, 12*b*. In the depiction shown in FIG. 1, the counterpart contact 14 is in the non-inserted state. The inserted state, however, is not shown in the drawings.

The contact legs 10*a* and 10*b*, 12*a* and 12*b* situated opposite each other are embodied as approximately V-shaped at their free ends F and form V-shaped contact elements 20*a* and 20*b*; 22*a* and 22*b* extending toward each other. The contact elements 20*a* and 20*b*; 22*a* and 22*b* contact the counterpart contact 14 when it is in the inserted state, not shown in the drawings.

The contact legs 10*a* and 10*b*; 12*a* and 12*b* situated opposite each other are embodied as bent at their free ends F and the free ends F are oriented away from each other.

At its right end B in FIGS. 1 through 3, the spring contact 8*a* has a soldering lug 24 that permits the spring contact 8*a* to be soldered directly to a printed circuit board, which is shown in only schematic form in FIG. 2 and has the reference numeral 26. As shown in FIG. 3, four soldering pins 28*a*, 28*b*, 28*c*, and 28*d*, which are situated at the comers of a rectangle, are formed onto the soldering lug 24 and extend perpendicular to the central longitudinal axis M of the spring contact 8*a*. The soldering pins 28*a*, 28*b*, 28*c*, and 28*d* can be inserted into soldering holes 30 (not shown) provided on the printed circuit board 26 and soldered in place there.

The contact legs 10*a*, 10*b*, 12*a*, and 12*b* and the soldering lug 24 with the soldering pins 28*a*, 28*b*, 28*c*, and 28*d* are integrally formed out of a metal sheet.

As shown in FIG. 3, the spring legs 16*a* and 18*a* are formed onto the support wall 32*a* of an essentially U-shaped spring element 34 and the spring legs 16*b* and 18*b* are formed onto its support wall 32*b*. The two support walls 32*a* and 32*b* are positioned parallel to each other and are attached to each other by a bridge piece 33. The two support walls 32*a* and 32*b* that are attached to each other by the bridge piece 33, together with the spring legs 16*a*, 16*b*, 18*a*, and 18*b* form a spring element 34. The spring element 34 is integrally formed out of a steel sheet.

The spring element 34 embraces the opposing contact legs 10*a* and 10*b*, 12*a* and 12*b* so that the insides of the support walls 32*a* and 32*b* come to rest against the outsides of the contact legs 10*a* and 10*b*, 12*a* and 12*b*. FIG. 3 shows a state in which the spring element 34 is lifted up from the contact legs 10*a* and 10*b*, 12*a* and 12*b*. The spring element can be placed onto the contact legs 10*a* and 10*b*, 12*a* and 12*b* in the direction of the arrows P.

The outsides of the opposing contact legs 10*a* and 10*b* each have a hollow 36*a* and 36*b* in them and the outsides of the opposing contact legs 12*a* and 12*b* each have a hollow 37*a* and 37*b* in them. The insides of the spring legs 16*a* and 16*b* oriented toward the contact legs 10*a* and 10*b* each has a corresponding formed on projection 38*a* and 38*b*. The insides of the spring legs 18*a* and 18*b* oriented toward the contact legs

12*a* and 12*b* each has a corresponding projection 39*a* and 39*b* formed onto them. The projections 38*a* and 38*b*, 39*a* and 39*b* engage in the hollows 36*a* and 36*b*, 37*a* and 37*b*. In order to achieve this, the spring element 34 must be placed onto the contact legs 10*a* and 10*b*, 12*a* and 12*b* in the direction of the arrows P as shown in FIG. 3.

Figure 4:
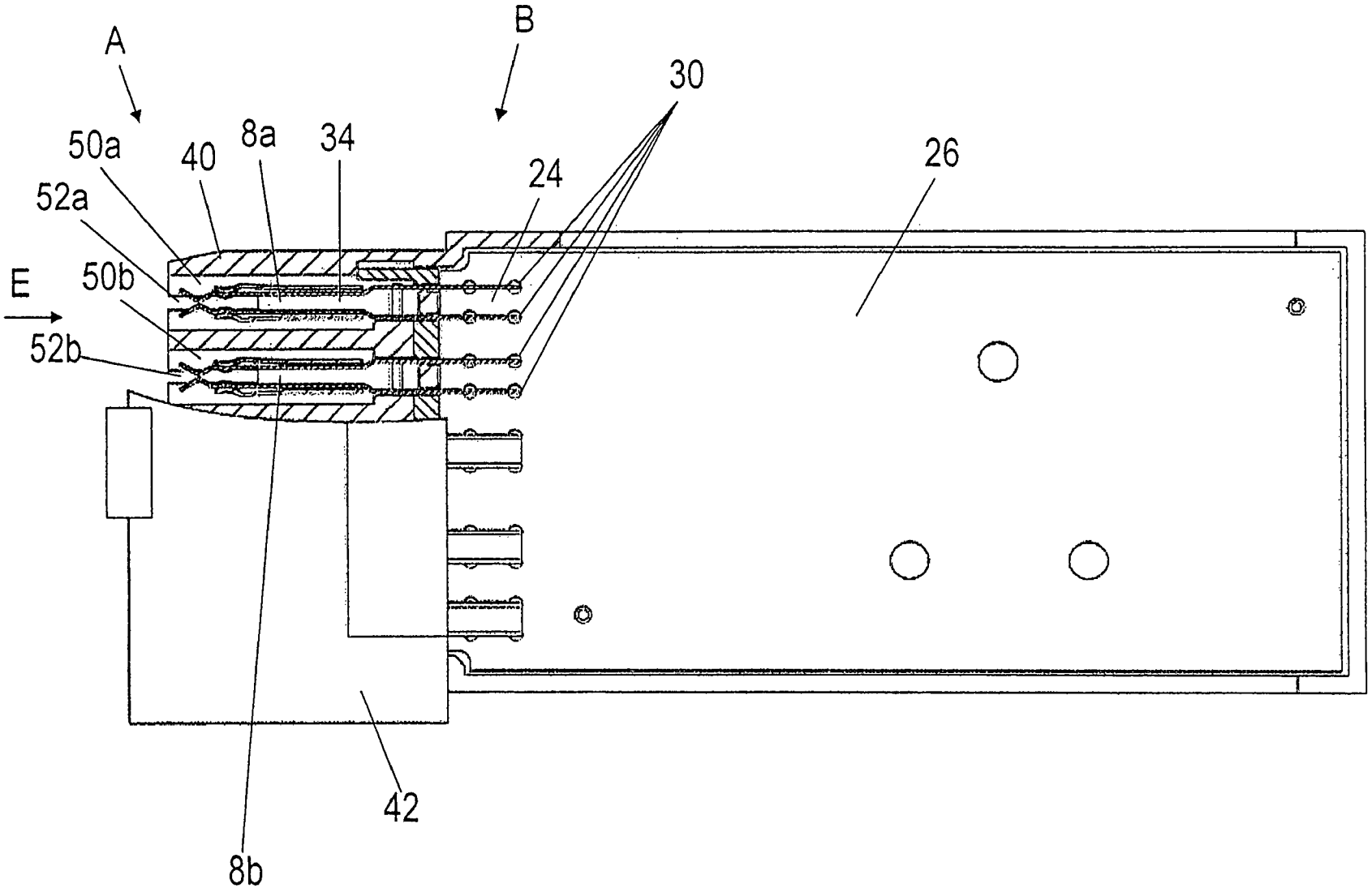
FIG. 4 is a schematic, partially sectional top view of a plug connection in which an upper housing component is of two parts and in which the part of the upper housing component that covers a connected printed circuit board is removed.

FIG. 4 is a schematic, partially sectional top view of a plug connection in which the upper housing component 42 is partially removed. The plug connection has five spring contacts 8*a*, 8*b*, 8*c*, 8*d*, 8*e* that are soldered parallel to one another on one side of a printed circuit board 26. The soldering pins, not shown in the depiction in FIG. 4, of the soldering lug 24 are inserted into soldering holes 30 in the printed circuit board 26.

The spring contacts 8*a*, 8*b*, 8*c*, 8*d*, and 8*e* are supported from underneath by a shared lower housing component 40. The spring contacts 8*a*, 8*b*, 8*c*, 8*d*, and 8*e* are covered from above by a shared upper housing component 42. The printed circuit board 26 is at least partially supported by the lower housing component 40. In addition, the printed circuit board can also be covered by the upper housing component 42. As shown in FIG. 4, the upper housing component 42 is of two parts, and the part of the upper housing component that covers the printed circuit board 26 is not shown.

The lower housing component 40 and the upper housing component 42 form cavities in the plug connection of which the only cavities shown in the partially cutaway depiction in FIG. 4 have reference numerals 50*a* and 50*b*. The spring contacts are situated in the cavities 50*a* and 50*b*, and the spring contacts shown in the partially cutaway view of FIG. 4 have the reference numerals 8*a* and 8*b*. The cavities 50*a* and 50*b* are open in the insertion direction E of the counterpart contact 14.

Figure 5:
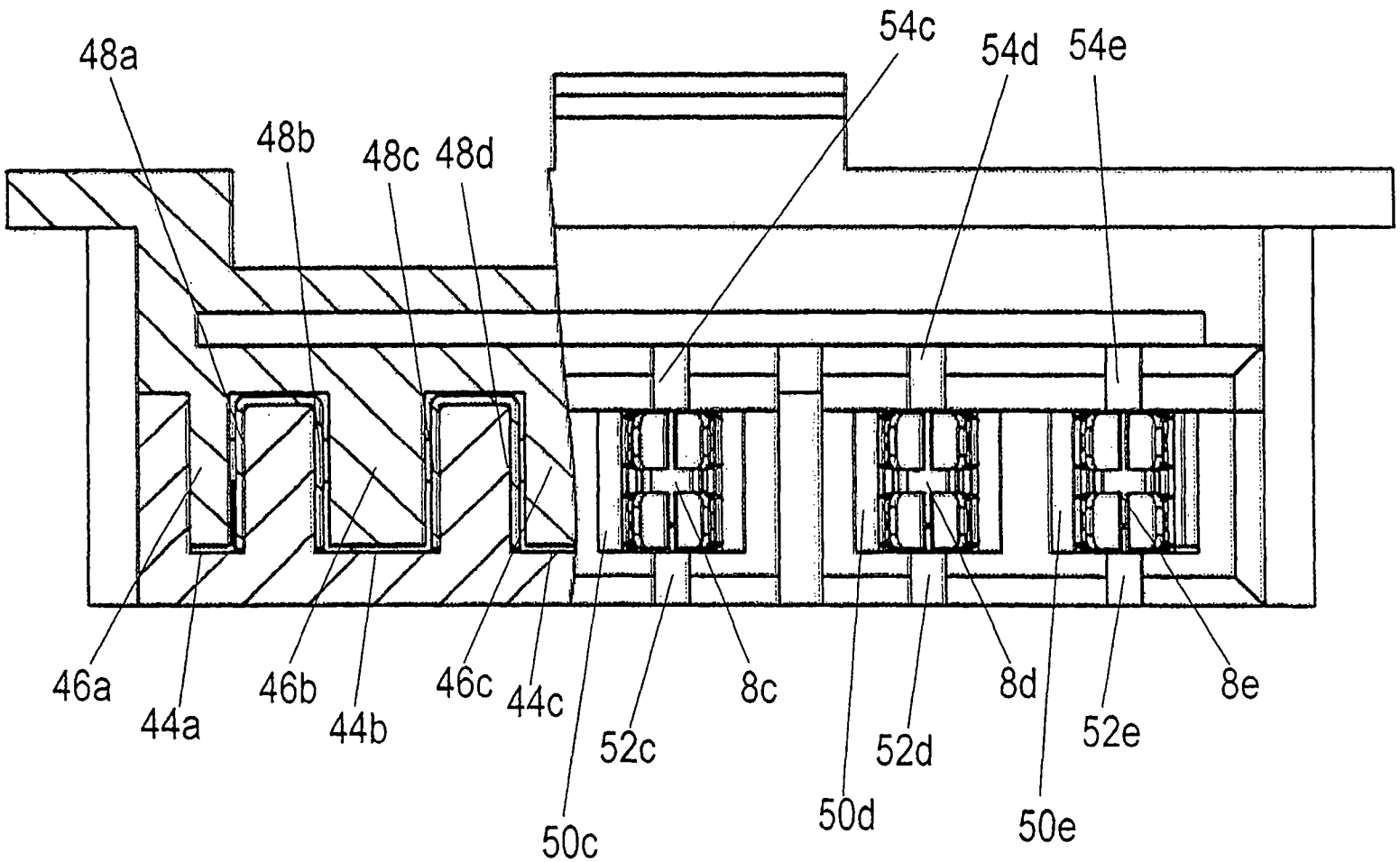
FIG. 5 is a schematic, partially sectional front view of the plug connection shown in FIG. 4.

FIG. 5 is a schematic, partially sectional front view of the plug connection shown in FIG. 4.

In the cavities 50*c*, 50*d*, and 50*e* shown in FIG. 5, two opposing slots 52*c* and 54*c*, 52*d* and 54*d*, 52*e* and 54*e* extend perpendicular to the central longitudinal axis M, which extends into the plane of the drawing in the view of FIG. 5. The slots receive counterpart contacts 14 embodied in the form of knife blade contacts. During insertion, the respective knife blade contact is oriented so that it extends through between two opposing contact legs. The opposing slots 52*c* and 54*c*, 52*d* and 54*d*, 52*e* and 54*e* are thus situated in the plane defined by the knife blade contact.

Corresponding slots are also embodied in the cavities 50*a* and 50*b* shown in FIG. 4, and only the slots with the reference numerals 52*a* and 52*b* are shown in the partially sectional depiction in FIG. 4.

In the region of or near the spring contacts 8*a* and 8*b* shown in FIG. 4, the lower housing component 40 has a plurality of recesses of which only the ones with the reference numerals 44*a*, 44*b*, and 44*c* are shown in FIG. 5. The recesses 44*a*, 44*b*, and 44*c* extend perpendicular to the central longitudinal axis M. The recesses 44*a*, 44*b*, and 44*c* receive projections that are formed onto the upper housing component 42 and protrude in a comb-like fashion in the direction of the lower housing component 40, of which only the projections with the reference numerals 46*a*, 46*b*, and 46*c* are shown in FIG. 5.

The contact legs 10*a* and 10*b*, 12*a* and 12*b* of the spring contacts 8*a*, 8*b*, 8*c*, 8*d*, and 8*e* with the spring legs 16*a* and 16*b*, 18*a* and 18*b* placed against them can be inserted through the vertical slots 48*a*, 48*b*, 48*c*, and 48*d* that are defined between the recesses 44*a*, 44*b*, and 44*c* of the lower housing component 40 and the projections 46*a*, 46*b*, and 46*c* of the upper housing component 42. In this instance, the slot widths are determined by the sheet thicknesses of the contact legs 10*a* and 10*b*, 12*a* and 12*b* and the spring legs 16*a* and 16*b*, 18*a* and 18*b*.

German Patent Reference 10 2007 032 992.1, the priority document corresponding to this invention, and its teachings are incorporated, by reference, into this specification.

What is claimed is:

1. A spring contact for an electrical plug connection at one end (A) having at least two spring-elastic contact legs (10*a*, 10*b*; 12*a*, 12*b*) situated opposite each other for receiving a counterpart contact (14) insertable between the two contact legs (10*a*, 10*b*; 12*a*, 12*b*) in an insertion direction (E) along a central longitudinal axis (M) of the spring contact, the spring contact comprising:

a hollow (36*a*, 36*b*; 37*a*, 37*b*) formed in each of the at least two spring-elastic contact legs (10*a*, 10*b*; 12*a*, 12*b*);

spring legs (16*a*, 16*b*; 18*a*, 18*b*)each positioned alongside one of the at least two spring-elastic contact legs (10*a*, 10*b*; 12*a*, 12*b*), the spring legs each including a projection (38*a*, 38*b*, 38*c*, 38*d*);

outsides of the contact legs (10*a*, 10*b*; 12*a*, 12*b*) oriented away from the central longitudinal axis (M); and wherein each projection (38*a*, 38*b*, 38*c*, 38*d*) of the each of the spring legs (16*a*, 16*b*; 18*a*, 18*b*) is engaged in a corresponding hollow (36*a*, 36*b*; 37*a*, 37*b*) of one of the spring-elastic contact legs (10*a*, 10*b*; 12*a*, 12*b*), and each of the spring legs (16*a*, 16*b*; 18*a*, 18*b*) press the respective opposing contact legs (10*a*, 10*b*; 12*a*, 12*b*) toward each other perpendicular to the central longitudinal axis (M) and, when a counterpart contact (14) is inserted exert a respective contact pressure on the counterpart contact (14).

2. The spring contact as recited in claim 1, wherein at the one end (A), a plurality of spring-elastic contact legs (10*a*, 10*b*; 12*a*, 12*b*) are arranged opposite one another in pairs, the counterpart contact (14) is insertable between the opposing pairs of contact legs (10*a*, 10*b*; 12*a*, 12*b*) in an insertion direction (E) along the central longitudinal axis (M) of the spring contact and the outside of each contact leg (10*a*, 10*b*; 12*a*, 12*b*) is engaged by a respective spring leg (16*a*, 16*b*; 18*a*, 18*b*).

3. The spring contact as recited in claim 2, wherein the contact legs (10*a*, 10*b*; 12*a*, 12*b*) situated opposite each other are approximately V-shaped at their free ends (F) and form V-shaped contact elements (20*a*, 20*b*; 22*a*, 22*b*) that extend toward each other and contact the counterpart contact (14) when inserted.

4. The spring contact as recited in claim 3, wherein the free ends (F) of the contact legs (10*a*, 10*b*; 12*a*, 12*b*) situated opposite each other are bent and the free ends (F) are oriented away from each other.

5. The spring contact as recited in claim 4, wherein at an other end (B) the spring contact has a soldering lug (24) formed on which permits the spring contact (8*a*, 8*b*, 8*c*, 8*d*, 8*e*) to be soldered directly to a printed circuit board (26).

6. The spring contact as recited in claim 5, wherein the soldering lug (24) has a plurality of soldering pins (28*a*, 28*b*, 28*c*, 28*d*) formed on which extend perpendicular to the central longitudinal axis (M) of the spring contact, and can be inserted into soldering holes (30) in the printed circuit board (26).

7. The spring contact as recited in claim 6, wherein the contact legs (10*a*, 10*b*; 12*a*, 12*b*) and the soldering lug (24) with the soldering pins (28*a*, 28*b*, 28*c*, 28*d*) are integrally formed out of a metal sheet.

8. The spring contact as recited in claim 7, wherein the spring legs (16*a*, 16*b*; 18*a*, 18*b*) extend essentially parallel to the associated contact legs (10*a*, 10*b*; 12*a*, 12*b*).

9. The spring contact as recited in claim 8, wherein the spring legs (16*a*, 16*b*; 18*a*, 18*b*) are formed onto the parallel extending support walls (32*a*, 32*b*) of an essentially U-shaped spring element (34) which embraces the opposing contact legs (10*a*, 10*b*; 12*a*, 12*b*) so that insides of the support walls (32*a*, 32*b*) rest against the outsides of the contact legs (10*a*, 10*b*; 12*a*, 12*b*).

10. The spring contact as recited in claim 9 supported by a lower housing component (40) and covered by an upper housing component (42).

11. The spring contact as recited in claim 10, wherein the printed circuit board (26) is at least partially supported by the lower housing component (40) and is at least partially covered by the upper housing component (42).

12. The spring contact as recited in claim 11, wherein perpendicular to the central longitudinal axis (M), the lower housing component (40) has a plurality of recesses (44*a*, 44*b*, 44*c*) for receiving projections (46*a*, 46*b*, 46*c*) formed onto the upper housing component (42) and that protrude in comb-like fashion in a direction of the lower housing component (40).

13. The spring contact as recited in claim 12, wherein the contact legs (10*a*, 10*b*; 12*a*, 12*b*) with the spring legs (16*a*, 16*b*; 18*a*, 18*b*) placed against them are inserted through vertical slots (48*a*, 48*b*, 48*c*, 48*d*) defined between recesses (44*a*, 44*b*, 44*c*) of the lower housing component (40) and projections (46*a*, 46*b*, 46*c*) of the upper housing component (42) and slot widths are determined by a sheet thicknesses of the contact legs (10*a*, 10*b*; 12*a*, 12*b*) and the spring legs (16*a*, 16*b*; 18*a*, 18*b*).

14. The spring contact as recited in claim 13, wherein the lower housing component (40) and the upper housing component (42) form cavities (50*a*, 50*b*, 50*c*, 50*d*, 50*e*) which are open at least in the insertion direction (E) of the counterpart contact (14).

15. The spring contact as recited in claim 14, wherein each of the cavities (50*a*, 50*b*, 50*c*, 50*d*, 50*e*) contains at least two opposing slots (52*a*; 52*b*; 52*c*, 54*c*; 52*d*, 54*d*; 52*e*, 54*e*) extending perpendicular to the central longitudinal axis (M) and that are used for insertion of counterpart contacts (14) in a form of knife blade contacts.

16. The spring contact as recited in claim 1, wherein the contact legs (10*a*, 10*b*; 12*a*, 12*b*) situated opposite each other are approximately V-shaped at their free ends (F) and form V-shaped contact elements (20*a*, 20*b*; 22*a*, 22*b*) that extend toward each other and contact the counterpart contact (14) when inserted.

17. The spring contact as recited in claim 1, wherein free ends (F) of the contact legs (10*a*, 10*b*; 12*a*, 12*b*) situated opposite each other are bent and the free ends (F) are oriented away from each other.

18. The spring contact as recited in claim 1, wherein at an other end (B) the spring contact has a soldering lug (24) formed on which permits the spring contact (8*a*, 8*b*, 8*c*, 8*d*, 8*e*) to be soldered directly to a printed circuit board (26).

19. The spring contact as recited in claim 1, wherein the spring legs (16*a*, 16*b*; 18*a*, 18*b*) extend essentially parallel to the associated contact legs (10*a*, 10*b*; 12*a*, 12*b*).

20. The spring contact as recited in claim 1, wherein the spring legs (16*a*, 16*b*; 18*a*, 18*b*) are formed onto the parallel extending support walls (32*a*, 32*b*) of an essentially U-shaped spring element (34) which embraces the opposing contact legs (10*a*, 10*b*; 12*a*, 12*b*) so that insides of the support walls (32*a*, 32*b*) rest against the outsides of the contact legs (10*a*, 10*b*; 12*a*, 12*b*).

21. The spring contact as recited in claim 1, supported by a lower housing component (40) and covered by an upper housing component (42).

22. The spring contact as recited in claim 21, wherein perpendicular to the central longitudinal axis (M), the lower housing component (40) has a plurality of recesses (44*a*, 44*b*, 44*c*) for receiving projections (46*a*, 46*b*, 46*c*) formed onto the upper housing component (42) and that protrude in comb-like fashion in a direction of the lower housing component (40).

23. The spring contact as recited in claim 21, wherein the lower housing component (40) and the upper housing component (42) form cavities (50*a*, 50*b*, 50*c*, 50*d*, 50*e*) which are open at least in the insertion direction (E) of the counterpart contact (14).

24. A spring contact for an electrical plug connection comprising:

two spring-elastic contact legs (10*a*, 10*b*; 12*a*, 12*b*) situated opposite each other for receiving a counterpart contact (14), each of the two spring-elastic contact legs (10*a*; 10*b*; 12*a*; 12*b*) including a hollow (36*a*, 36*b*; 37*a*, 37*b*) formed therein;

a U-shaped spring element (34) including two spring legs (16*a*, 16*b*; 18*a*, 18*b*) extending from two parallel extending support walls (32*a*, 32*b*), the two spring legs (16*a*, 16*b*; 18*a*, 18*b*) each including a projection (38*a*, 38*b*; 38*c*, 38*d*); and wherein the U-shaped spring element (34) receives the two spring-elastic contact legs (10*a*, 10*b*; 12*a*, 12*b*) so that insides of the support walls (32*a*, 32*b*) rest against outsides of the spring-elastic contact legs (10*a*, 10*b*; 12*a*, 12*b*) and the projection (38*a*, 38*b*; 39*a*, 39*b*) of each of the two spring legs (16*a*, 16*b*; 18*a*, 18*b*) sits within a corresponding hollow (36*a*, 36*b*; 37*a*, 37*b*) of one of the two spring-elastic contact legs (10*a*; 10*b*; 12*a*; 12*b*) to press the two spring-elastic contact legs (10*a*, 10*b*; 12*a*, 12*b*) toward each other perpendicular to a central longitudinal axis (M) and, when the counterpart contact (14) is inserted, exert a respective contact pressure on the counterpart contact (14).

25. The spring contact as recited in claim 24, wherein the two spring-elastic contact legs (10*a*, 10*b*; 12*a*, 12*b*) situated opposite each other are approximately V-shaped at their free ends (F) and form V-shaped contact elements (20*a*, 20*b*; 22*a*, 22*b*) that extend toward each other and contact the counterpart contact (14) when inserted.

26. The spring contact as recited in claim 25, wherein free ends (F) of the contact legs (10*a*, 10*b*; 12*a*, 12*b*) situated opposite each other are bent and the free ends (F) are oriented away from each other.

27. The spring contact as recited in claim 24, further comprising a soldering lug (24) which permits the spring contact (8*a*, 8*b*, 8*c*, 8*d*, 8*e*) to be soldered directly to a printed circuit board (26).

28. The spring contact as recited in claim 24, further comprising a lower housing component (40) and an upper housing component (42), wherein the lower housing component (40) and the upper housing component (42) at least partially surround the two spring legs (16*a*, 16*b*; 18*a*, 18*b*) and the two spring-elastic contact legs (10*a*; 10*b*; 12*a*; 12*b*).

* * * * *